United States Patent [19]

Onnen

[11] 4,164,211

[45] Aug. 14, 1979

[54] DAMPER ASSEMBLY

[75] Inventor: James H. Onnen, Louisville, Ky.

[73] Assignee: American Air Filter Company, Inc., Louisville, Ky.

[21] Appl. No.: 838,821

[22] Filed: Oct. 3, 1977

[51] Int. Cl.[2] ..... F23L 13/06

[52] U.S. Cl. ..... 126/285 A; 110/163; 251/175

[58] Field of Search ..... 126/285 R, 285 A, 285 B, 126/190; 251/175; 110/163

[56] References Cited

U.S. PATENT DOCUMENTS

| | | | |
|---|---|---|---|
| 2,582,877 | 1/1952 | Mekler | 126/285 A |
| 3,602,165 | 8/1971 | Huntington | 126/285 X |

*Primary Examiner*—Edward G. Favors
*Attorney, Agent, or Firm*—Jon C. Winger

[57] ABSTRACT

A damper assembly for use in gas-conducting conduits including a damper blade with a cavity therein for receiving a fluid and a plurality of outlet ports in flow communication with the cavity to provide means for providing a pressurized fluid seal around the damper blade when in a closed position.

5 Claims, 1 Drawing Figure

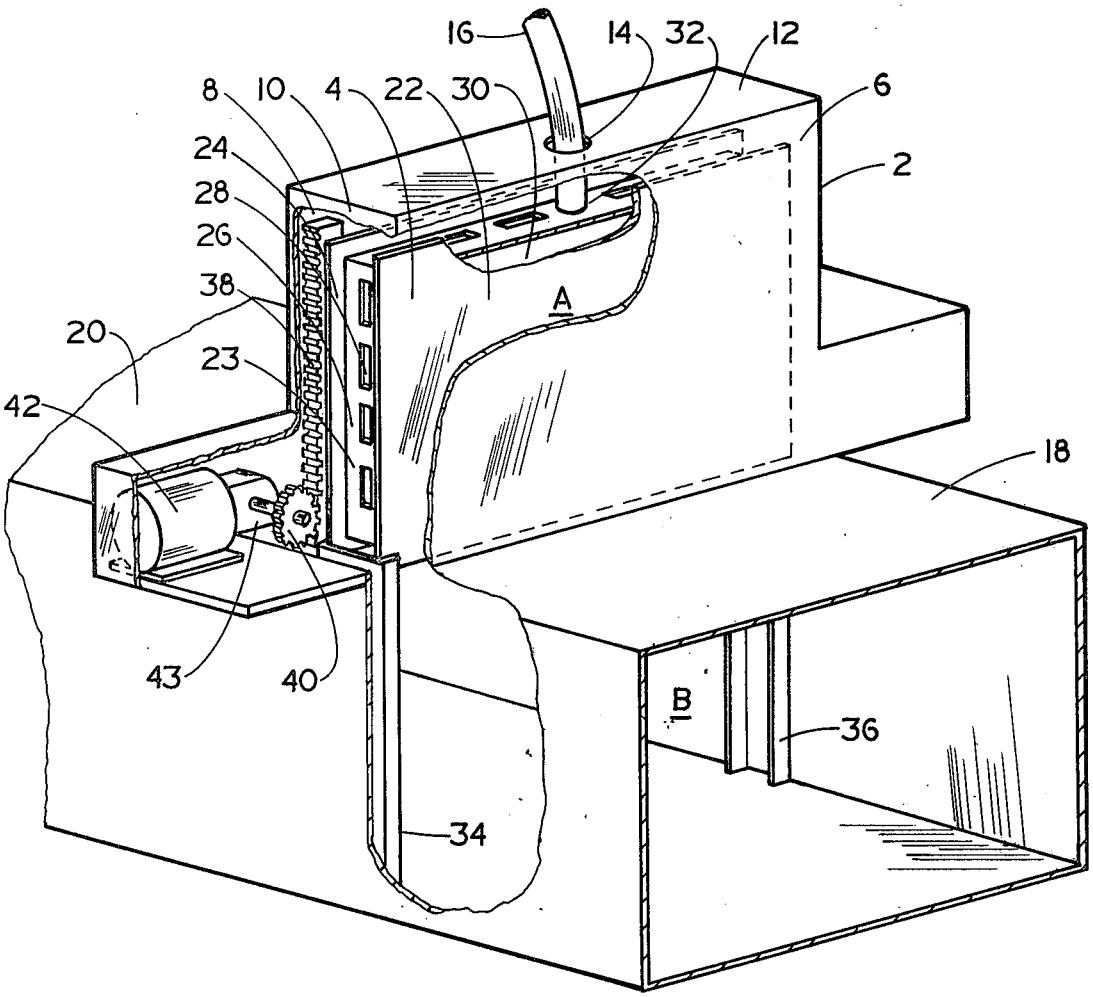
16
14
32
12
8
10
4
22
30
6
24
2
28
26
38
A
20
23
42
18
43
40
B
36
34

DAMPER ASSEMBLY

BACKGROUND OF THE INVENTION (1) Field of the Invention

The present invention relates to damper assemblies and more particularly relates to a damper assembly for use in gas-conducting conduits in gas treating installations.

(2) Description of the Prior Art

In large gas-conducting conduit systems such as those used in the cleaning of waste gases evolving from metallurgical and chemical operations, it is necessary, generally, to provide damper assemblies for controlling the flow rate of gases through the system. In many installations it is extremely important that reliable tight or nearly tight shut-off dampers be used. In flue gas cleaning systems for utility boilers, for example, dampers must be opened to permit the passage of flue gas through the ducts and must be closed to isolate flue gas cleaning equipment, such as, gas scrubbers, and by-pass the flue gas around the equipment to avoid shutdown of the utility boiler or other device. The damper must effectively isolate the equipment being by-passed so that the equipment can be safely inspected, and so that internal maintenance may be performed. Furthermore, in many applications, hot corrosive gases are present in the gas stream and upon cooling of the gas stream, particularly during shutdown, the corrosive gases condense thereby promoting corrosion of the damper assemblies.

In the prior art, complex and expensive sealing arrangements as well as expensive materials of construction for damper assemblies have been utilized.

SUMMARY OF THE INVENTION

The present invention advantageously provides a damper assembly for a gas-conducting conduit in gas treating installations. The present invention further provides a damper assembly including a hollow damper blade through which a heated gas from outside the assembly passes into the damper assembly through the hollow blade and exit ports located therein to maintain a seal around the blade and also to maintain the damper assembly above a preselected temperature.

Various other features of the present invention will become obvious to those skilled in the art upon reading the disclosure set forth hereinafter.

More particularly, the present invention provides a damper assembly comprising: a casing having a flow-through inlet and a flow-through outlet; a movable damper blade disposed within the casing, the damper blade having a cavity for receiving a fluid therein; a plurality of openings in the blade in flow communication with the cavity; means to add a fluid to the damper blade cavity; and, means to move the damper blade within the casing from an open to a closed position.

It is to be understood that the description of the examples of the present invention given hereinafter are not by way of limitation and various modifications within the scope of the present invention will occur to those skilled in the art upon reading the disclosure set forth hereinafter.

BRIEF DESCRIPTION OF THE DRAWING

Referring to the drawing:

The FIGURE is a perspective view, with selected portions cut-away, of one preferred damper assembly of the present invention.

DESCRIPTION OF THE PREFERRED EMBODIMENT

In the FIGURE a casing 2 is provided for encasing a damper blade 4 therein. In a preferred embodiment, the casing 2 is divided into two compartments or sections, an upper section A to encase the blade 4 when the system is in a flow-through condition and a lower section B when the system is in a no-flow condition. The upper section A is enclosed by parallel spaced vertically extending front and back members 6 and 8, respectively, and spaced vertically extending side members 10, only one being shown. A top member 12 connecting all four vertical members is provided to complete the enclosure, top member 12 being provided with an opening 14 therein to receive a flexible tubular conduit 16 therethrough. Conduit 16 is in fluid communication with a hot, pressurized gas source (not shown).

The lower section B is provided with flow-through openings therein axially aligned with flow-through openings in ducts 18 and 20 to allow for the passage of a gas therethrough.

Damper blade 4 is provided with a pair of parallel spaced vertically extending front and back plates 22 and 24, respectively, spaced apart by means of peripheral spacing member 26. Spacing member 26 is spaced inwardly from the outer edges of the plates 22 and 24 thereby defining a peripheral channel 23 around the outer edge of the blade 4 and a cavity 30 therein. Spacing member 26 is further provided with an opening 32 to receive flexible tubular conduit 16 whereby hot gases enter cavity 30 through the conduit 16. Spacing member 26 is also provided with a plurality of spaced apertures 28 providing outlet ports for the hot gases in cavity 30.

A pair of facing opposed spaced channel guide frames 34 and 36 are provided to receive the damper blade 4 for slidable movement therein. Guide frames 34 and 36 extend vertically from the bottom of lower section B to the top of upper section A thereby providing a guide for the damper blade 4 from a closed to an open position.

Means are provided for moving the damper blade 4 from one position to another and in the example, as shown, a rack 38 is fixedly attached along an outer edge of the damper blade 4 and vertically movable in response to turning of pinion 40. Pinion 40 is turned in response to actuation of electric motor 42 through appropriate gearing indicated by numeral 43 but not shown in detail since appropriate gearing is well known in the art. It is realized that other means for moving damper blade 4 may be utilized without departing from the scope and spirit of the present invention.

In the operation of a damper assembly of the present invention, particularly in a closed position, a hot, pressurized fluid, usually air enters the cavity 30 of the damper blade 4 through conduit 16. The hot fluid heats up the damper blade 4 exiting through the outlet ports 28. The exiting hot fluids provide a seal along the guide frames 34 and 36 thereby preventing the gases on one side of the damper blade 4 from leaking around the blade 4 to the other side.

It will be realized that various changes may be made to the specific embodiment shown and described without departing from the scope and spirit of the present invention.

What is claimed is:

1. A damper assembly comprising:

a casing having a flow-through inlet and a flow-through outlet;

a movable damper blade disposed within said casing, said damper blade including a pair of parallel spaced plates spaced apart by a spacing member extending around the periphery of said plates and defining a cavity for receiving a fluid therein, said spacing member being spaced inwardly from the outer edges of said plates defining a peripheral channel along the outer edge of said damper plate;

a plurality of openings in said blade in flow communication with said cavity;

means to add a fluid to said damper blade cavity;

said spacing member having an opening therein in communication with said means to add a fluid to said cavity; and, means to move said damper blade within said casing from an open to a closed position.

2. The damper assembly of claim 1, said spacing member having a plurality of flow-through outlet ports in flow communication with said cavity.

3. The damper assembly of claim 1, said means to add a fluid to said damper blade cavity including a flexible tubular member in flow communication with said opening in said spacing member.

4. The damper assembly of claim 1, said casing having a pair of spaced guide frames of U-shaped cross-section on opposite sides of said damper blade slidably receiving said parallel spaced plates therein.

5. The damper assembly of claim 1, said casing having a pair of spaced opposed guide frames slidably receiving said damper blade therein.

* * * * *